US007065998B2

(12) United States Patent
Caporusso

(10) Patent No.: US 7,065,998 B2
(45) Date of Patent: Jun. 27, 2006

(54) CONTROL ELEMENT ADAPTED TO PREVENT AN EXTERNAL-FLANGE ANGLE IRON FROM BEING TWISTED DURING ITS BENDING

(75) Inventor: Alessandro Caporusso, Piedimonte San Germano (IT)

(73) Assignee: CML International S.p.A., San Geramano (IT)

( * ) Notice: Subject to any disclaimer, the term of this patent is extended or adjusted under 35 U.S.C. 154(b) by 21 days.

(21) Appl. No.: 10/483,660

(22) PCT Filed: Jul. 18, 2001

(86) PCT No.: PCT/IT01/00382

§ 371 (c)(1),
(2), (4) Date: Jul. 13, 2004

(87) PCT Pub. No.: WO03/008127

PCT Pub. Date: Jan. 30, 2003

(65) Prior Publication Data

US 2004/0237619 A1 Dec. 2, 2004

(51) Int. Cl.
*B21D 7/08* (2006.01)

(52) U.S. Cl. ..... 72/171

(58) Field of Classification Search ..... 72/171, 72/170, 173–175, 168

See application file for complete search history.

(56) References Cited

U.S. PATENT DOCUMENTS

| | | | | |
|---|---|---|---|---|
| 629,496 | A * | 7/1899 | Diescher | 72/171 |
| 702,836 | A * | 6/1902 | Weber | 72/168 |
| 924,758 | A * | 6/1909 | Gabriel | 72/171 |
| 2,365,882 | A | 12/1944 | Kane | |
| 2,696,242 | A * | 12/1954 | Knost | 72/167 |
| 3,704,616 | A * | 12/1972 | Taira | 72/167 |
| 4,008,595 | A * | 2/1977 | Allenspach | 72/170 |

FOREIGN PATENT DOCUMENTS

| | | |
|---|---|---|
| CH | 301 505 | 9/1954 |
| EP | 0 879 655 | 11/1998 |
| GB | 715 897 | 9/1954 |

* cited by examiner

*Primary Examiner*—Daniel C. Crane
(74) *Attorney, Agent, or Firm*—Young & Thompson

(57) ABSTRACT

A control element (1) adapted to prevent an external-flange angle iron from being twisted during its bending is applied to a variable-radius bending machine, on which an angle iron (10) is worked by deformation by at least two couples of lower co-axial rollers (7, 8, 7', 8') and at least a third upper roller (9), the one flange (11) of the angle iron (10) being clamped by the lower rollers (7, 8, 7', 8'), and the other flange (12) facing outward. The control element (1) includes a frustoconical head (2) pivoted on a stem (3) designed to be received into a co-axial housing hole that is frontally performed on the support element (13) of a cylindrical control roller (14), having three degrees of freedom, of the bending machine.

6 Claims, 2 Drawing Sheets

CONTROL ELEMENT ADAPTED TO PREVENT AN EXTERNAL-FLANGE ANGLE IRON FROM BEING TWISTED DURING ITS BENDING

TECHNICAL FIELD

The present invention relates to a control element adapted to prevent an external-flange angle iron from being twisted during its bending.

In particular, this bending operation is performed by a variable-radius bending machine. Such an element can be used on any kind of variable-radius bending machine, both symmetrical and asymmetrical. For simplicity and clarity sake, the use of a control element for a symmetrical pyramidal bending machine is shown below.

BACKGROUND ART

In a bending machine of this kind, an angle iron is detained by two couples of lower coaxial rollers through the one flange thereof clamped between said coaxial rollers and the other flange facing outwardly. When an angle iron is so positioned, it is called "external-flange" angle iron. While the angle iron is so clamped, it is worked by deformation by means of said lower rollers and a third roller travelling transversally toward the angle iron.

A working operation of this kind usually involves the generation of a twisting moment tending to modify the normal orthogonality of the flanges of the angle iron, causing a unacceptable deformation of twisting, that compromises the result of the working operation.

There are known prior art documents that disclose an anti-twisting action.

In U.S. Pat. No. 2,365,882 A (Kane & Roach Inc.), that doesn't relate to an "external-flange" angle iron, one flange of the angle iron is clamped by the upper roller, and the other flange thereof faces inwards.

GB 715 897 A (Leycure) discloses a bending machine, in which the angle iron being worked is positioned with both the flanges thereof being clamped among the upper roller and the lower rollers. A plate, which is coaxial to the upper roller, serves only the function to retain the angle iron against the upper roller and near the axis thereof, but doesn't allow for the twisting of the one flange of the angle iron to be prevented.

In a bending machine disclosed in CH 301 505 A (Kausler-Hutter), an angle iron being worked is not positioned with one flange thereof being clamped by said lower rollers, and the other flange facing outward. Further, the antitwisting action is performed on the internal flange of the angle iron, and not on the external flange.

DISCLOSURE OF THE INVENTION

The present invention aims to overcome this drawback that is not resolved by the existing cylindrical control rollers, having three degrees of freedom, normally used as counteracting elements when pipes or other sections different from angle irons are bent.

The present invention provides a control element adapted to prevent an external-flange angle iron from being twisted during its bending in a variable-radius bending machine, on which the angle iron is worked by deformation by means of at least two couples of lower co-axial rollers and at least a third upper roller, the one flange of the angle iron being clamped by said lower rollers, and the other flange facing outward, further the bending machine having frontally at least a cylindrical control roller with three degrees of freedom that is supported by its support element, the control element comprising a head pivoted on a stem designed to be received with its axis into a co-axial housing hole that is frontally performed on said support element of the cylindrical control roller, the head of the control element having an external surface intersecting the axis of the stem.

BRIEF DESCRIPTION OF THE DRAWINGS

The present invention will be now described with reference to the figures of the accompanying drawing, in which.

DETAILED DESCRIPTION OF THE PREFERRED EMBODIMENTS

Figure 1:
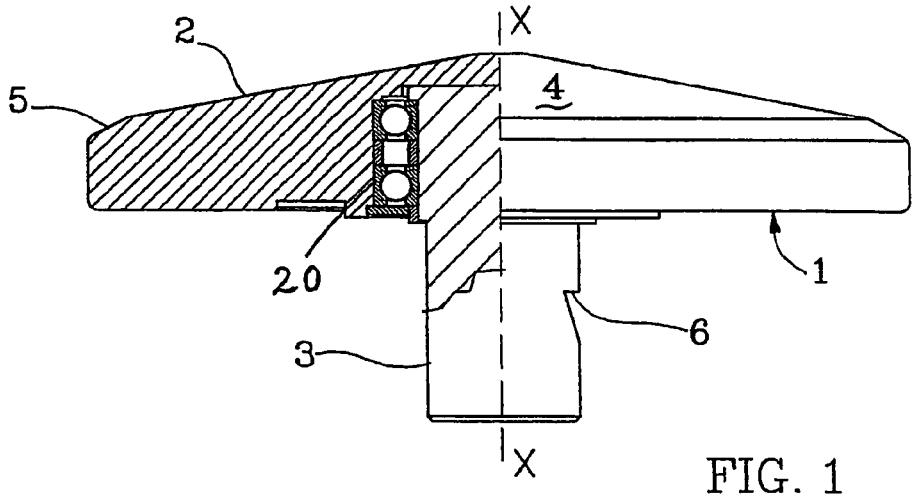
FIG. 1 shows a partially cross-sectioned side view of a control element according to the invention.
Figure 2:
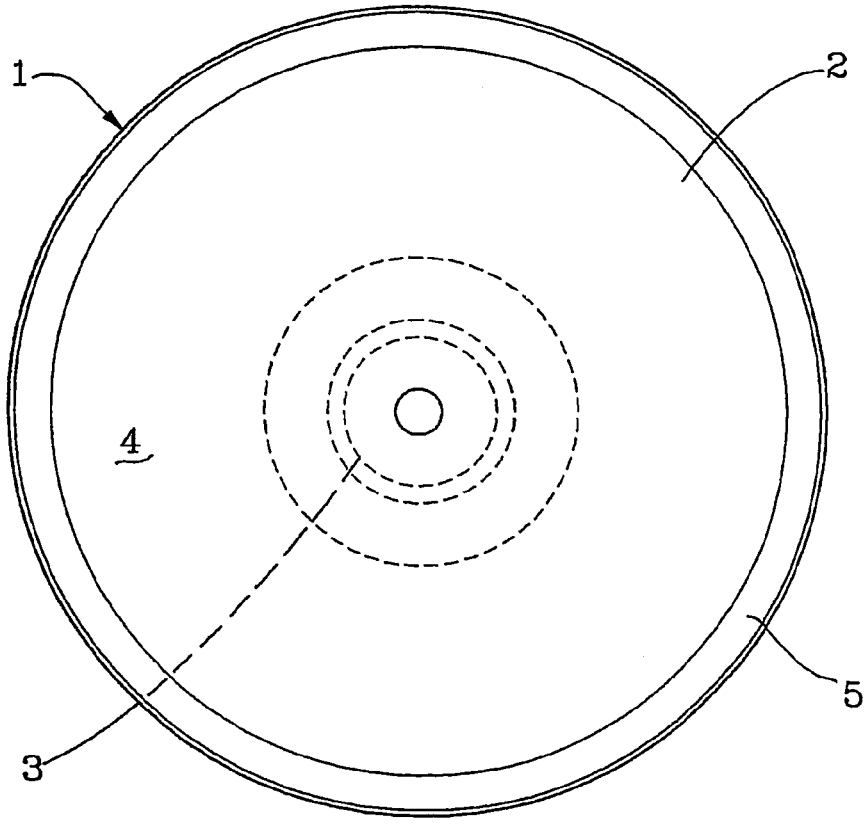
FIG. 2 shows a top view of the control element of FIG. 1.

With reference to the drawing, a control element, generally denoted as 1, is shown in FIG. 1. The control element 1 is constituted by a head 2 and a stem 3. The head 2 has a slanted external surface 4. The stem 3 has a central axis X—X intersecting the external surface 4. Preferably, the external surface 4 is shaped as a frustum of cone, but other shapes are not excluded, for example a conical shape.

Preferably, the head 2 has an external edge 5 that is chamfered with an angle of inclination greater than that one of the external surface 4 with respect to the axis X—X.

As shown in FIG. 1, the head 2 is pivoted on the stem 3 through a bearing 20. It is clear that, instead of the bearing 20, other cylindrical coupling means, such as a bushing, can be provided.

The stem 3 of the control element is provided with a notch 6 for a known retainer device (not shown).

The stem 3 is designed to be received into a correspondent housing hole which is frontally performed in a known support element 13 of a cylindrical control roller 14 having three degree of freedom (FIG. 3) and being conventionally used to bend pipes and other sections different from angle irons.

Figure 3:
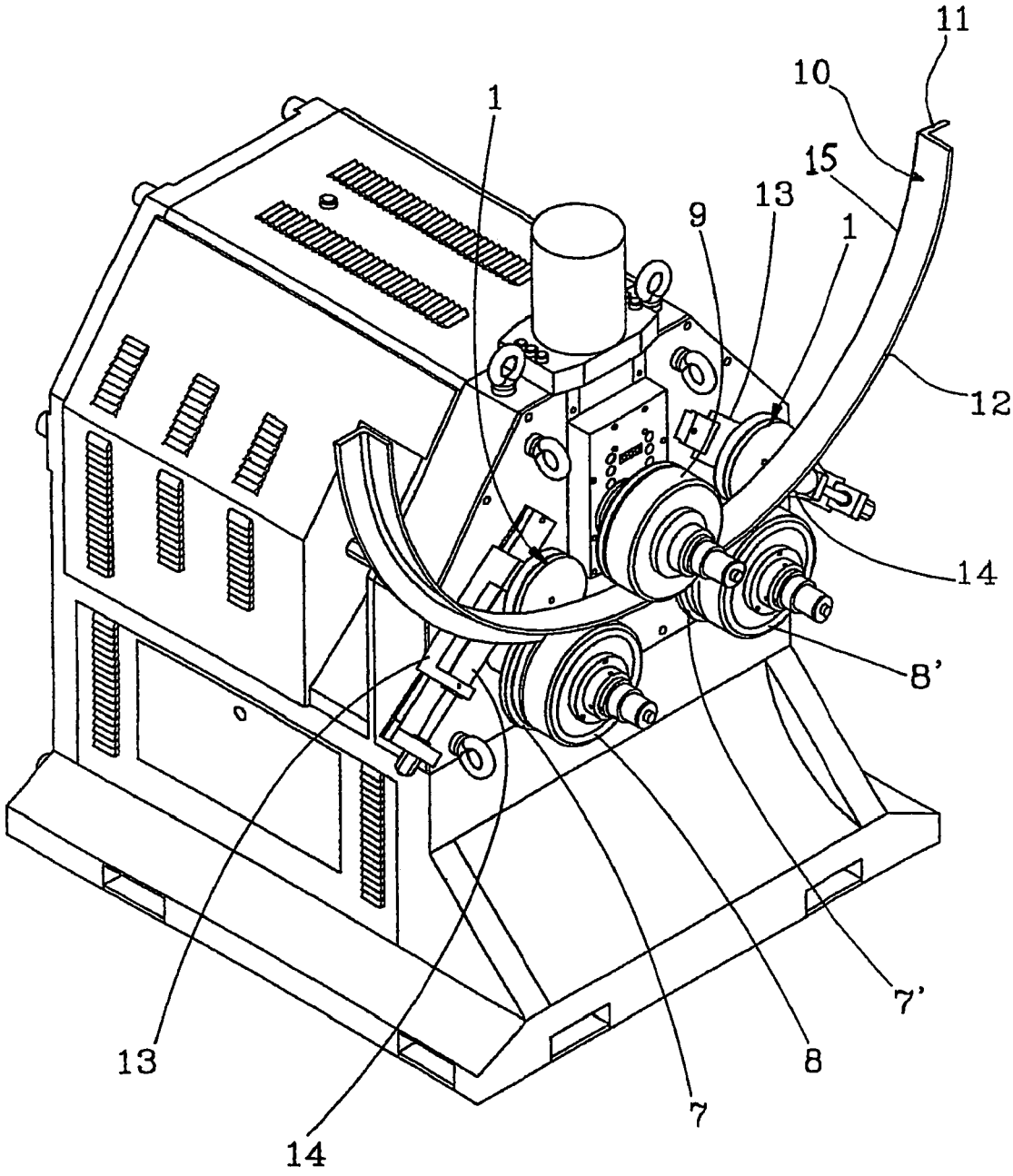
FIG. 3 shows an assonometric view of bending machine equipped with a control element according to the invention.

In the pyramidal symmetrical bending machine shown in FIG. 3, that is considered as an exemplar application of the control element according to the invention, there is a pair of support elements 13 for cylindrical control rollers. The bending machine has a double couple of lower co-axial rollers 7, 8, 7', 8' and a third upper roller 9.

A pair of control elements 1 adapted to prevent an external-flange angle iron from being twisted is used in bending an angle iron 10. The angle iron 10 is retained by means of two couples of lower rollers 7, 8 and 7', 8' through a flange 11 of the angle iron, which is clamped among the lower rollers while other flange 12 is facing outward. The flanges 11 and 12 cross each other in a flange edge 15 forming a right angle. The angle iron 10 is worked by deformation by means of these couples of rollers together with the third upper roller 9.

The control elements 1 are fitted through their stems 3 into holes (not shown) that are frontally and horizontally performed in the support elements 13 of the cylindrical control rollers 14 having three degrees of freedom.

The chamfered peripheral edge 5 of the control elements 1 helps the angle iron 10 engaging the control element 1. The control element 1 receives the angle iron 10 in contact with its slanted work engaging external surface 4 in a portion thereof under its central axis X—X in order to keep vertically the flange 11 and prevent the flange edge 15 from turning toward the bending machine. In this way, during the working operation the angle iron 10 being bent travels without any deformation of twisting.

Obviously, shape and dimensions of the control elements can be modified in the spirit of the enclosed claims.

The invention claimed is:

1. A variable-radius bending machine, comprising:

a control element adapted to prevent an external-flange angle iron from being twisted during bending, said angle iron having flanges;

at least two couples of lower co-axial rollers and at least a third upper roller, one of said flanges of the angle iron being clamped by said lower rollers, and one of said flanges facing outward, the angle iron being worked by deformation by said upper and lower rollers;

at least one cylindrical control roller with three degrees of freedom, said at least one control roller being located at a front of said machine; and a support element supporting said control roller, wherein said control element comprises a head pivoted on a stem, said stem being received into a co-axial housing hole that is frontally formed on said support element of the cylindrical control roller, the head of the control element having a work engaging external surface intersecting an axis of the stem.

2. The bending machine according to claim 1, wherein the external surface of said head of the control element is frustoconical.

3. The bending machine according to claim 2, wherein the head of the control element has a peripheral chamfered edge.

4. A variable-radius bending machine, comprising:

a control element that prevents an external-flange angle iron having first and second flanges from being twisted during bending, said control element comprising a head pivotally mounted on a stem, said head of the control element having a work engaging external surface intersecting an axis of the stem;

at least two pair of lower co-axial rollers and at least a third upper roller, said first flange of the angle iron being clamped by said pair of lower rollers, and said second flange facing away from said machine, the angle iron being worked by deformation by said upper and lower rollers;

at least one cylindrical control roller; and a support element supporting said control roller, said stem of the control element being received into a housing hole that is on said support element of the cylindrical control roller.

5. The bending machine according to claim 4, wherein the external surface of said head of said control element is frustoconical.

6. The bending machine according to claim 5, wherein the head of the control element has a peripheral chamfered edge.

* * * * *